US007472571B1

(12) United States Patent
Chang

(10) Patent No.: US 7,472,571 B1
(45) Date of Patent: Jan. 6, 2009

(54) TWO-HANDLED LOCK

(75) Inventor: Jing-Chen Chang, Yun-Lin Hsien (TW)

(73) Assignee: EZ Trend Technology Co., Ltd., Chia-Yi County (TW)

( * ) Notice: Subject to any disclaimer, the term of this patent is extended or adjusted under 35 U.S.C. 154(b) by 0 days.

(21) Appl. No.: 11/966,104

(22) Filed: Dec. 28, 2007

(51) Int. Cl.
*E05B 13/10* (2006.01)

(52) U.S. Cl. ..... 70/472; 70/149; 70/222; 70/224; 292/DIG. 27

(58) Field of Classification Search ..... 70/149, 70/188, 189, 215–218, 221–224, 422, 472, 70/473, DIG. 31; 292/DIG. 27
See application file for complete search history.

(56) References Cited

U.S. PATENT DOCUMENTS

| | | | | | |
|---|---|---|---|---|---|
| 1,374,908 | A * | 4/1921 | Davenport et al. | ..... | 70/222 |
| 1,560,503 | A * | 11/1925 | Doenges | ..... | 70/222 |
| 1,560,504 | A * | 11/1925 | Doenges | ..... | 70/222 |
| 2,459,920 | A * | 1/1949 | Clark | ..... | 70/223 |
| 3,024,055 | A * | 3/1962 | Novarino | ..... | 292/169.18 |
| 3,196,644 | A * | 7/1965 | Russell et al. | ..... | 70/224 |
| 3,212,306 | A * | 10/1965 | Russell et al. | ..... | 70/224 |
| 3,269,158 | A * | 8/1966 | Andre | ..... | 70/216 |
| 3,556,576 | A * | 1/1971 | Nelson et al. | ..... | 292/359 |
| 4,201,069 | A * | 5/1980 | Katayama et al. | ..... | 70/422 |
| 5,301,526 | A * | 4/1994 | Fann et al. | ..... | 70/224 |
| 5,927,777 | A * | 7/1999 | Kuo et al. | ..... | 292/358 |
| 6,470,721 | B2 * | 10/2002 | Ming | ..... | 70/224 |
| 6,807,833 | B1 * | 10/2004 | Huang et al. | ..... | 70/107 |
| 6,993,945 | B1 * | 2/2006 | Chen | ..... | 70/472 |
| 2004/0237608 | A1 * | 12/2004 | Chen | ..... | 70/224 |
| 2006/0042337 | A1 * | 3/2006 | Su | ..... | 70/472 |
| 2007/0169525 | A1 | 7/2007 | Chang | | |

* cited by examiner

*Primary Examiner*—Lloyd A Gall
(74) *Attorney, Agent, or Firm*—Darby & Darby P.C.

(57) ABSTRACT

A lock includes inside and outside handles mounted rotatably on a lock housing unit, a key-operated lockset mounted to the outside handle, a rotary knob mounted to the inside handle, a handle-connecting rod co-rotatable with the inside handle, a driven seat co-rotatable with the handle-connecting rod, a lock-connecting rod interconnecting the lockset and the rotary knob, and an engaging plate disposed movably within a slot in the driven seat. The lock-connecting rod is rotatable to move the engaging plate between a connection position whereat the engaging plate projects from the driven seat so as to allow for co-rotation of the outside handle with the handle-connecting rod, and a retracted position whereat the engaging plate is retracted into the driven seat so as to prevent co-rotation of the outside handle with the handle-connecting rod.

6 Claims, 9 Drawing Sheets

TWO-HANDLED LOCK

BACKGROUND OF THE INVENTION

1. Field of the Invention

This invention relates to a lock, and more particularly to a two-handled lock that is operable to allow for or prevent co-rotation of a handle with a handle-connecting rod.

2. Description of the Related Art

Referring to FIGS. 1 and 2, an electric door lock disclosed in US Patent Application Publication No. 2007/0169525 includes an internal lock housing 11, an inside handle 12, an external lock housing 13, an outside handle 14, a handle-connecting rod 15 co-rotatable with the inside and outside handles 12, 14, two return units 16 for returning the inside and outside handles 12, 14, respectively, an electric driving unit 17, and a lock-controlling mechanism 2.

The external lock housing 13 includes a hole-defining wall 132 having a mounting hole 131 and two engaging grooves 134, and a projecting annular wall 133 disposed around the mounting hole 131. The outside handle 14 includes a handle housing 141, and a cylindrical part 142 disposed within and co-rotatable with the handle housing 141. The cylindrical part 142 is formed with two engaging holes 143 aligned respectively with the engaging grooves 134 in the external lock housing 13.

The lock-controlling mechanism 2 includes a rotary knob 21 mounted to the inside handle 12, a key-operated lockset 22 mounted to the outside handle 14, a lock-connecting rod 23 in the form of a plate and interconnecting the rotary knob 21 and the lockset 22, and two latching plates 24, 24' sleeved on the lock-connecting rod 23 and aligned with the engaging grooves 134 in the external lock housing 13. Each of the latching plates 24, 24' has a rod-engaging portion 242 having a rod-engaging hole 241, as well as a balance portion 243 and a retaining portion 244 extending from two opposite sides of the rod-engaging portion 242 and away from each other. The rod-engaging hole 241 in each of the latching plates 24, 24' has a generally horizontal hole portion 245, and a generally vertical hole portion 246. The balance portion 243 of each of the latching plates 24, 24' is aligned with the retaining portion 244 of the other of the latching plates 24, 24' along a longitudinal direction of the lock-connecting rod 23.

When the latching plates 24, 24' are disposed in latching positions shown in FIGS. 1 and 3, the lock-connecting rod 23 is vertical, and the retaining portions 244 of the latching plates 24, 24' project respectively into the engaging grooves 134 in the external lock housing 13 to thereby prevent rotation of the inside and outside handles 12, 14. The lock can be locked through operation of any of the lockset 22, the rotary knob 21, and the electric driving unit 17 to move the latching plates 24, 24' to the latching positions.

When the latching plates 24, 24' are disposed in unlatching positions shown in FIG. 2, the lock-connecting rod 23 is horizontal, and the retaining portions 244 of latching plates 24, 24' are retracted into the engaging holes 143 in the outside handle 14 to thereby allow for rotation of the inside and outside handles 12, 14.

Although the aforesaid door lock can achieve its intended purpose, the latching plates 24, 24' are easily deformed and therefore malfunction when a large torque is applied thereto. This may be done by attaching a tool to the outside handle 14 to increase the moment arm associated with a torque applied to the outside handle 14. When the latching plates 24, 24' are sufficiently deformed, the outside handle 14 can be pivoted to open the door.

SUMMARY OF THE INVENTION

The object of this invention is to provide a two-handled lock that can overcome the above-mentioned disadvantage associated with the prior art.

According to this invention, a lock includes inside and outside handles mounted rotatably on a lock housing unit, a key-operated lockset mounted to the outside handle, a rotary knob mounted to the inside handle, a handle-connecting rod co-rotatable with the inside handle, a driven seat co-rotatable with the handle-connecting rod, a lock-connecting rod interconnecting the lockset and the rotary knob, and an engaging plate disposed movably within a slot in the driven seat. The lock-connecting rod is rotatable to move the engaging plate between a connection position whereat the engaging plate projects from the driven seat so as to allow for co-rotation of the outside handle with the handle-connecting rod, and a retracted position whereat the engaging plate is retracted into the driven seat so as to prevent co-rotation of the outside handle with the handle-connecting rod.

As such, when the engaging plate is moved to the retracted position to thereby lock the two-handled lock, rotation of the outside handle cannot result in deformation of the engaging plate and unlocking of the two-handled lock.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
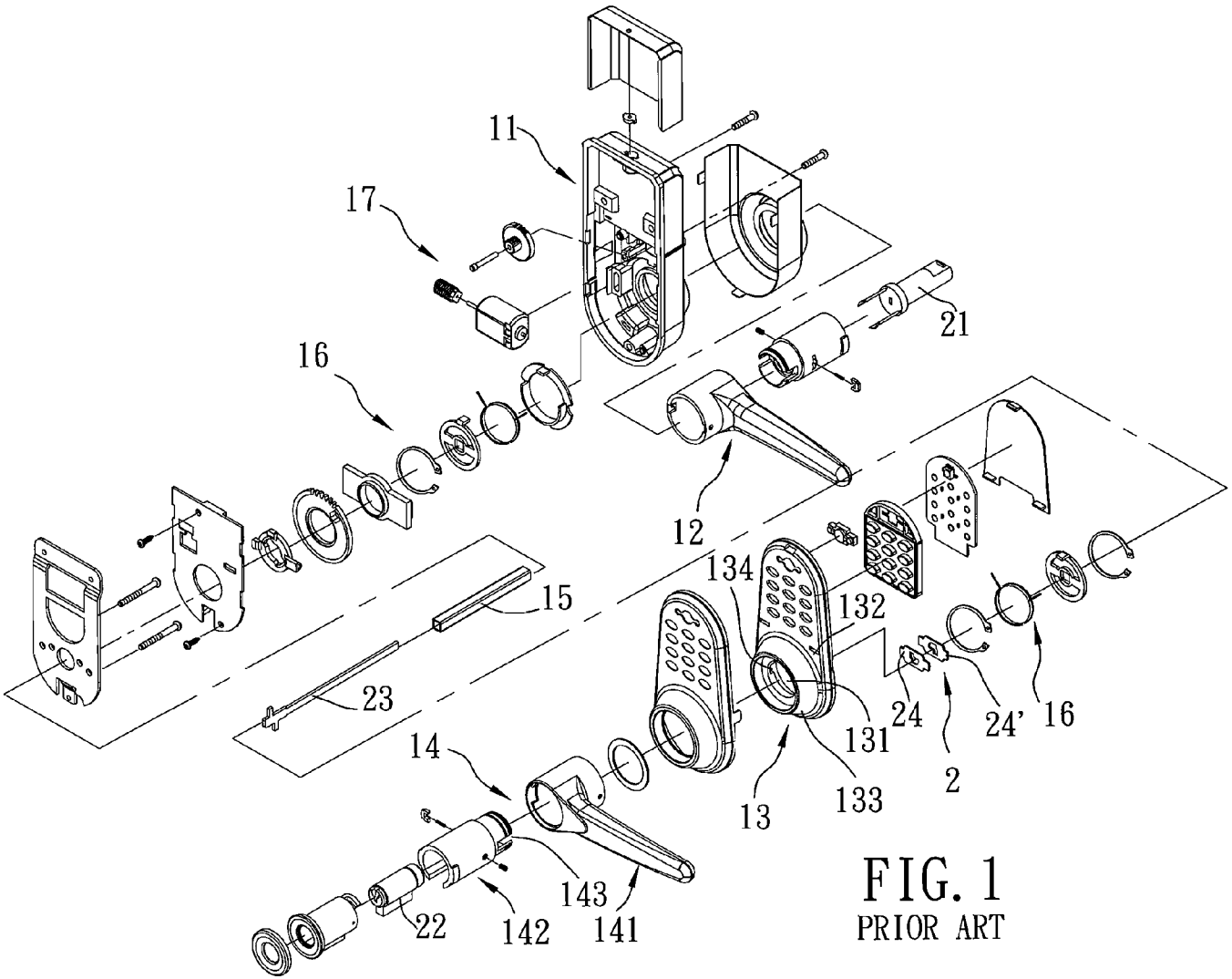
FIG. 1 PRIOR ART
FIG. 1 is an exploded perspective view of an electric door lock disclosed in US Patent Application Publication No. 2007/0169525.
Figure 2:
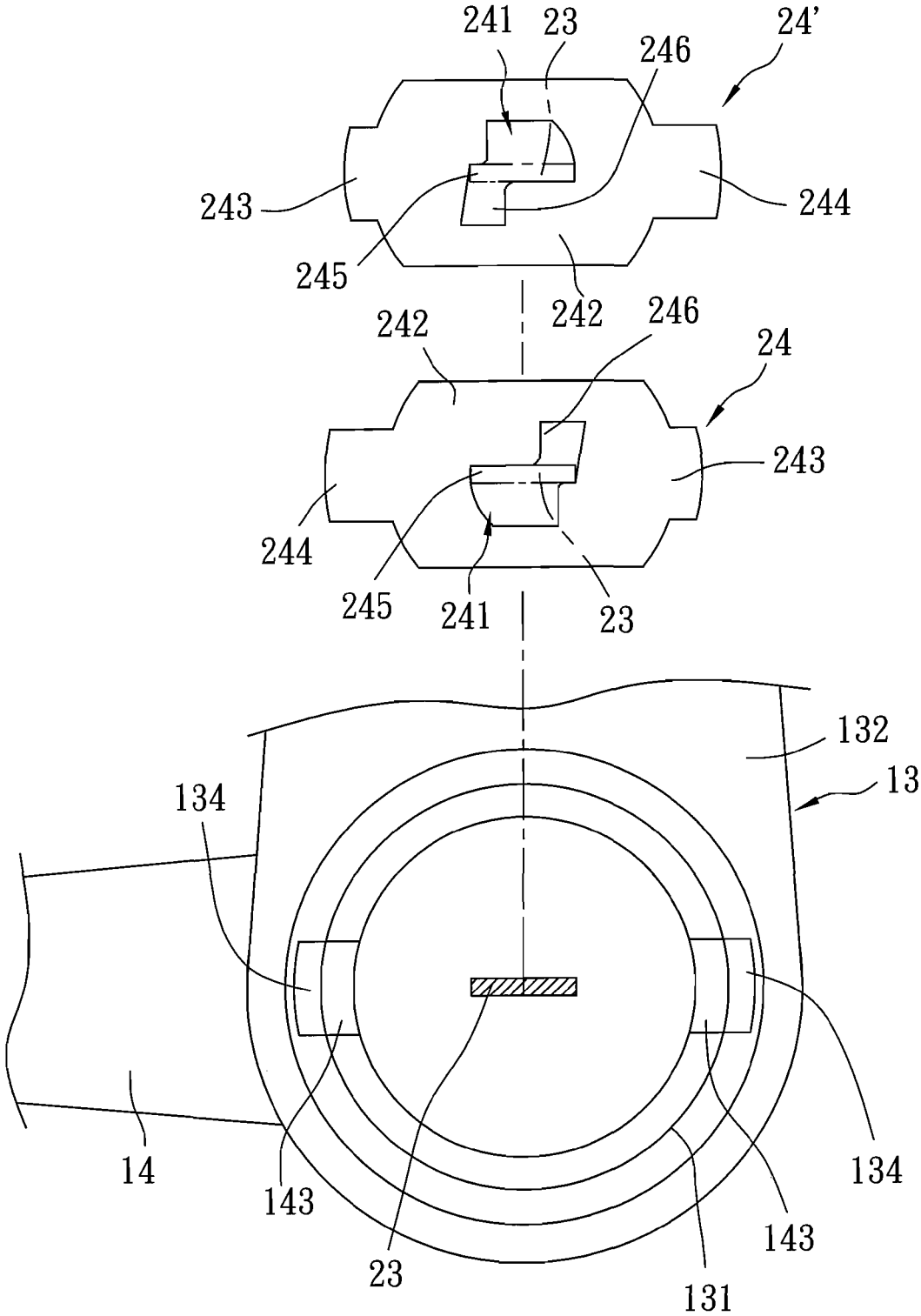
FIG. 2 PRIOR ART
FIG. 2 is a fragmentary exploded schematic view of the electric door lock shown in FIG. 1 when two latching plates are disposed in unlatching positions to unlock the door lock.
Figure 3:
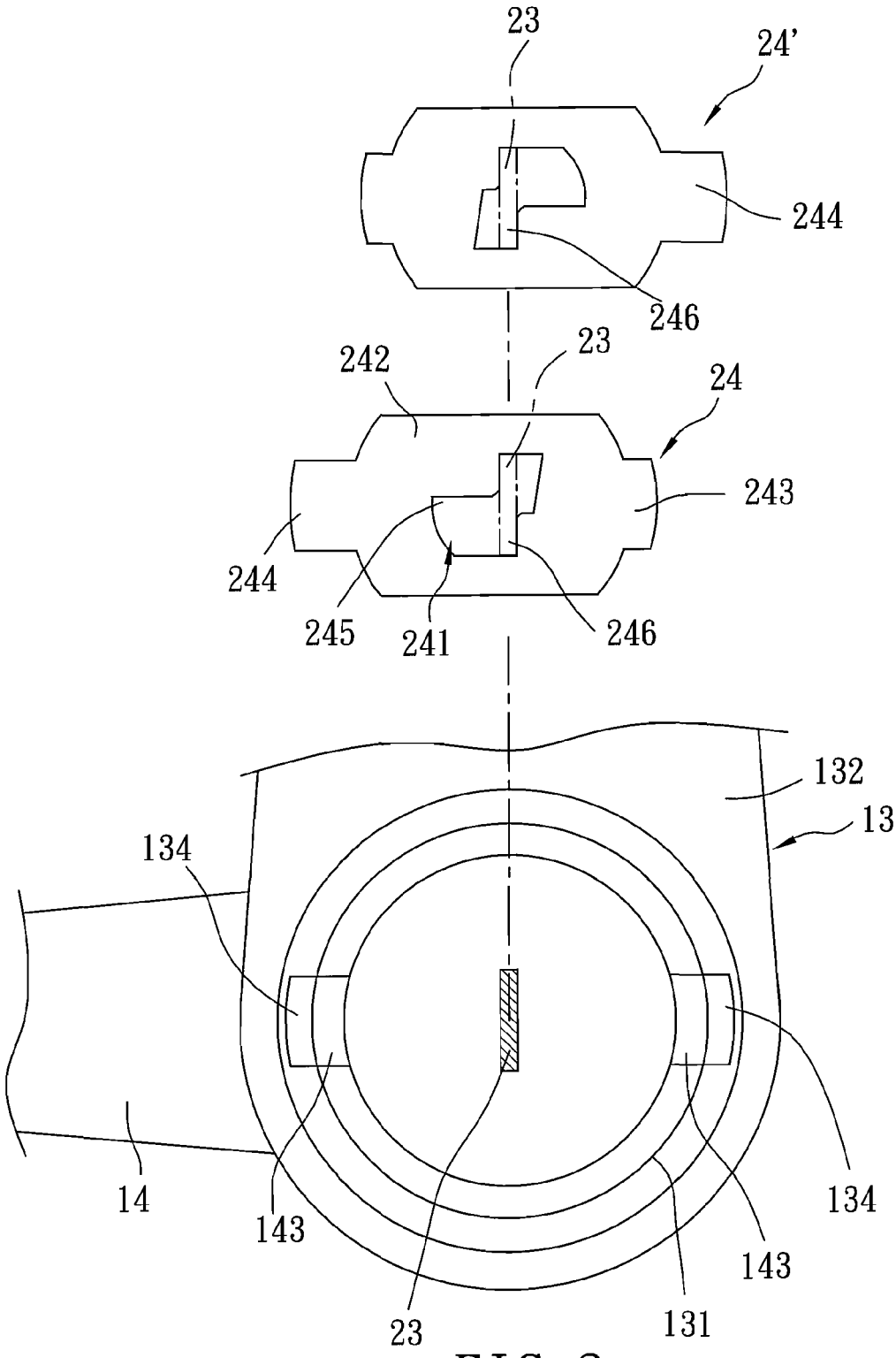
FIG. 3 PRIOR ART
FIG. 3 is a fragmentary exploded schematic view of the electric door lock shown in FIG. 1 when the latching plates are disposed in latching positions to lock the door lock.
Figure 4:
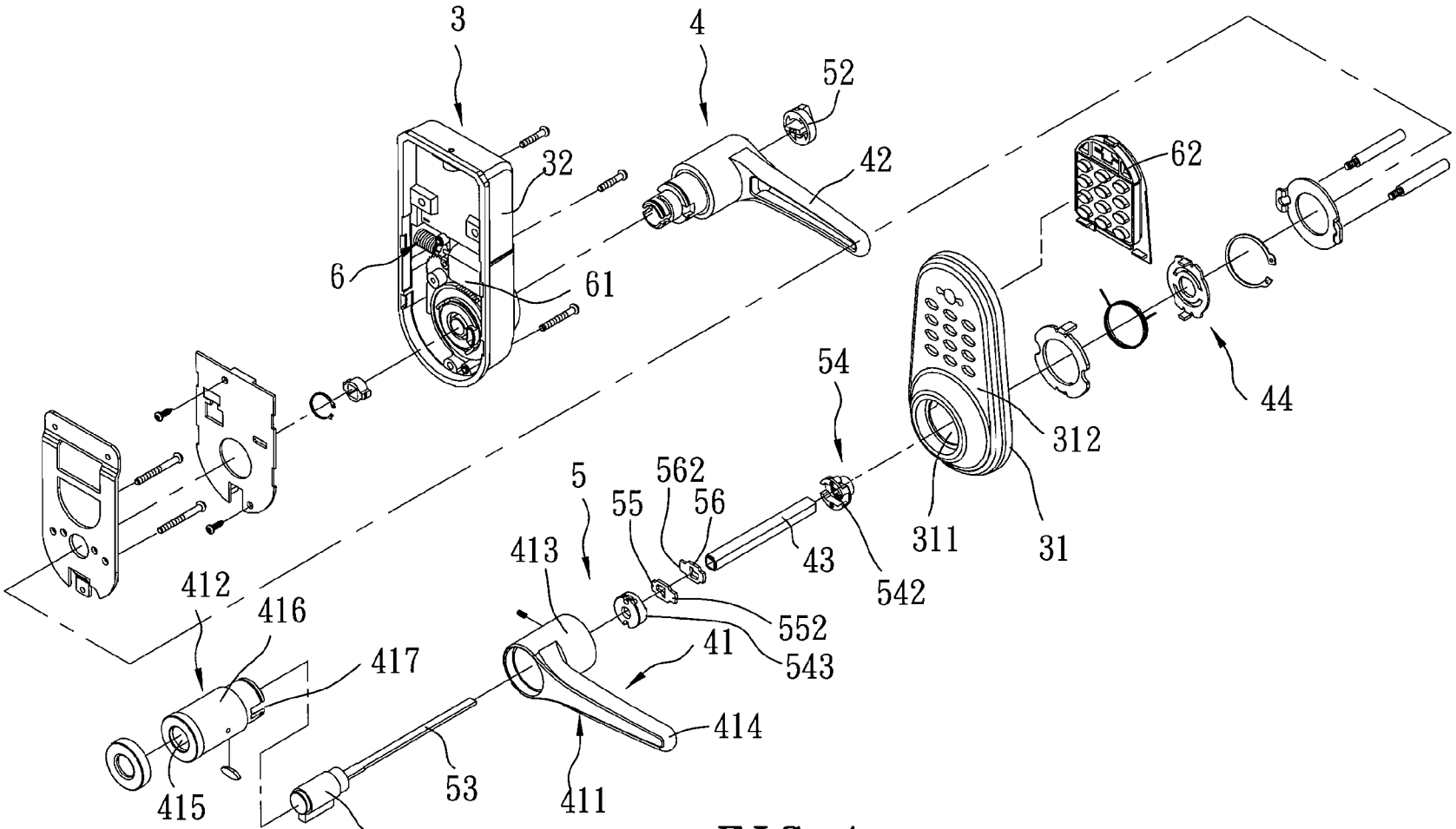
FIG. 4 is an exploded perspective view of the preferred embodiment of a two-handled lock according to this invention.
Figure 5:
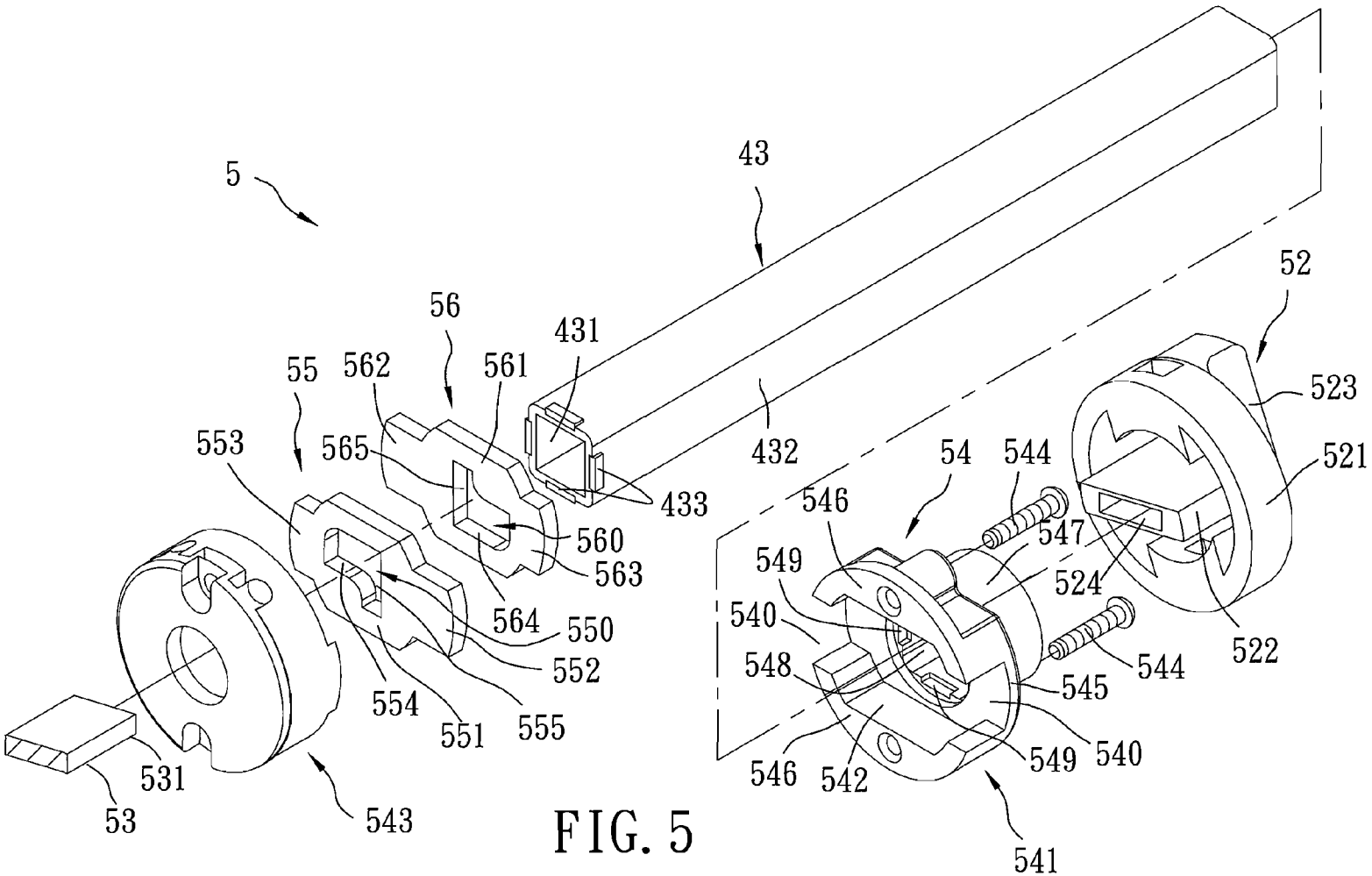
FIG. 5 is an exploded perspective view of a handle-connecting rod and a lock-controlling mechanism of the preferred embodiment.

Referring to FIGS. 4 and 5, the preferred embodiment of a two-handled lock according to this invention includes a lock housing unit 3, a handle unit 4, a lock-controlling mechanism 5, and an electric driving mechanism 6. The lock housing unit 3 includes an external lock housing 31 disposed on an outer side surface of a door (not shown), and an internal lock housing 32 disposed on an inner side surface of the door. The external lock housing 31 has a wall 312 formed with a mounting hole 311.

The handle unit 4 includes an outside handle 41 mounted rotatably on the external lock housing 31 and extending into the mounting hole 311, an inside handle 42 disposed rotatably on the internal lock housing 32, a handle-connecting rod 43 connected to and co-rotatable with the inside handle 42, and a return unit 44 for returning the outside handle 41. The outside handle 41 includes a handle housing 411 and a generally cylindrical part 412. The handle housing 411 has a cylindrical portion 413 and a grip lever 414 extending radially and outwardly from the cylindrical portion 413. The return unit 44 biases the grip lever 414 to a horizontal position. The cylindrical part 412 has a receiving chamber 415 defined by a surrounding wall 416. The surrounding wall 416 is formed with two aligned notches 417. The handle-connecting rod 43 is configured as a rectangular tube, and has a tube wall 432 defining a central bore 431, and four projections 433 extending from an end of the tube wall 432. The handle-connecting rod 43 is rotatable to move a spring bolt (not shown).

The lock-controlling mechanism 5 includes a key-operated lockset 51 mounted within the receiving chamber 415 in the outside handle 41, a rotary knob 52 mounted rotatably on the inside handle 42, a lock-connecting rod 53 connected between and rotatable by the lockset 51 and the rotary knob 52, a driven seat 54 disposed rotatably within the receiving chamber 415 in the outside handle 41 and co-rotatable with the handle-connecting rod 43, and a pair of first and second engaging plates 55, 56. The rotary knob 52 includes a cap portion 521, a surrounding wall 522 extending from the cap portion 521 in a direction toward the lock-connecting rod 53, and an actuation block 523 extending from the cap portion 521 in a direction away from the lock-connecting rod 53. The surrounding wall 522 defines an insert hole 524 having a rectangular cross-section. The lock-connecting rod 53 is configured as a plate, and has an insert end 531 (see FIG. 5) received fittingly within the insert hole 524 in the rotary knob 52 so as to allow for co-rotation of the lock-connecting rod 53 with the rotary knob 52.

The driven seat 54 includes a first seat half 541 sleeved on and co-rotatable with the handle-connecting rod 43, and a second seat half 543 connected fixedly to the first seat half 541 by bolts 544 to define an open-ended slot 542 therebetween. The slot 542 has two opposite open ends 540. The first seat half 541 has a plate portion 545, two slot walls 546 extending from a side of the plate portion 545 toward the second seat half 543 to define the slot 542 between the slot walls 546, and a surrounding wall portion 547 extending from an opposite side of the plate body 545 in a direction away from the slot walls 546. The plate portion 545 and the surrounding wall portion 547 cooperate to define an insert hole 548 engaging fittingly the handle-connecting rod 43 so as to allow for co-rotation of the first seat half 541 and the handle-connecting rod 43. The surrounding wall portion 547 has an inner surface formed with four positioning grooves 549. The projections 433 of the handle-connecting rod 43 engage respectively the positioning grooves 549 in the surrounding wall portion 547.

Figure 6:
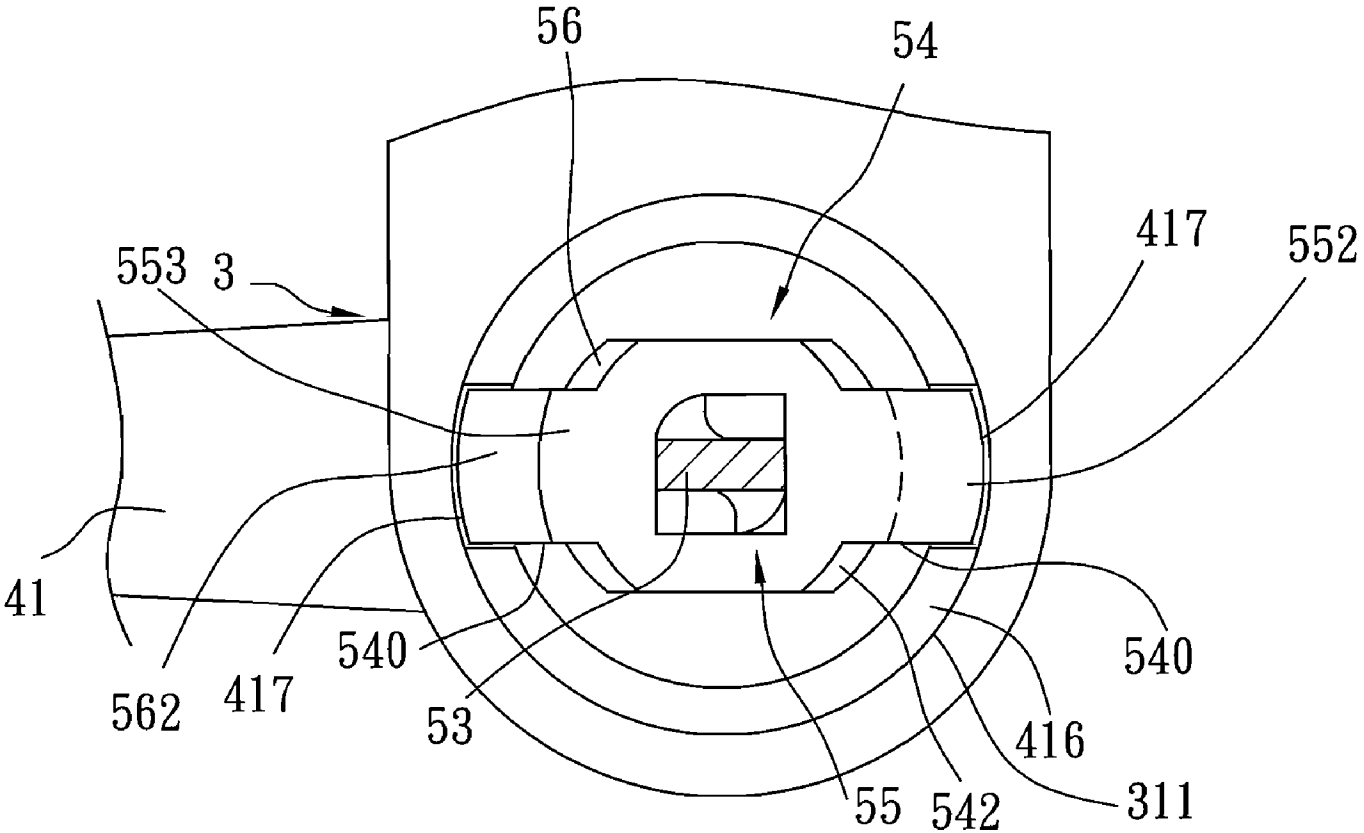
FIG. 6 is a fragmentary schematic view of the preferred embodiment, illustrating how first and second engaging plates are disposed in connection positions.
Figure 7A:
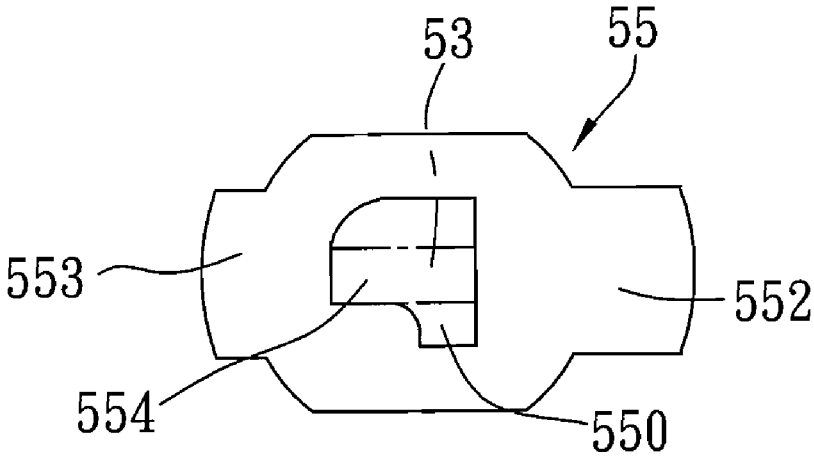
FIG. 7A is a fragmentary schematic view of the preferred embodiment, illustrating positioning of a lock-connecting rod relative to the first engaging plate when the first engaging plate is disposed in the connection position.
Figure 7B:
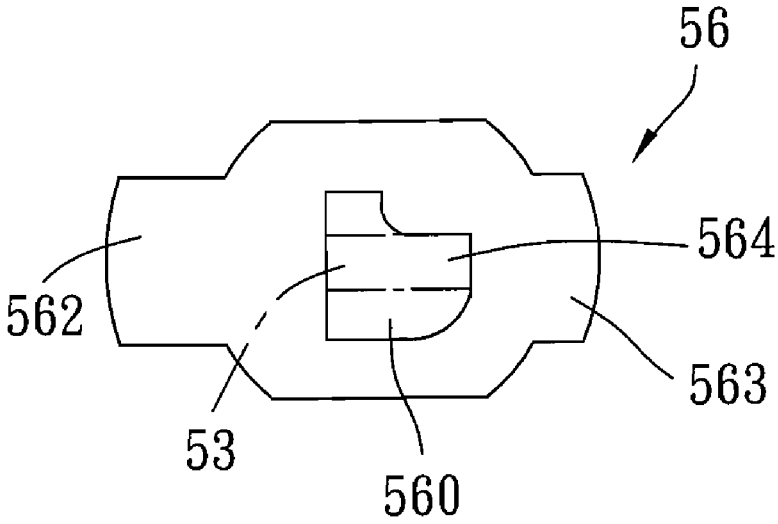
FIG. 7B is a fragmentary schematic view of the preferred embodiment, illustrating positioning of the lock-connecting rod relative to the second engaging plate when the second engaging plate is disposed in the connection position.
Figure 8:
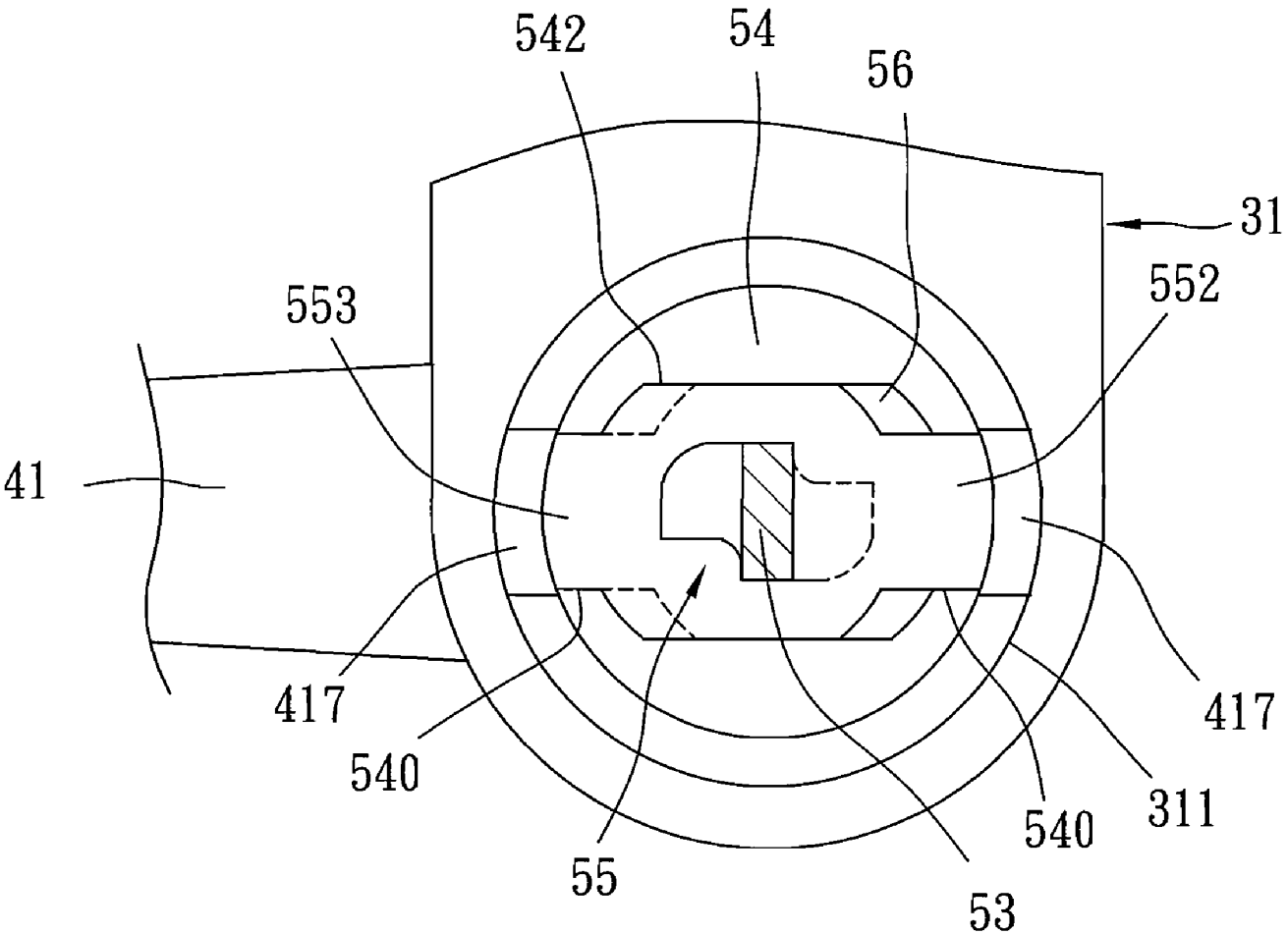
FIG. 8 is a fragmentary schematic view of the preferred embodiment, illustrating how the first and second engaging plates are disposed in retracted positions.

Each of the first and second engaging plates 55, 56 has a rod-engaging portion 551, 561 formed with a rod-engaging hole 550, 560 allowing for extension of the lock-connecting rod 53 therethrough, a retaining portion 552, 562 extending from a side of the rod-engaging portion 551, 561, and a balance portion 553, 563 extending from an opposite side of the rod-engaging portion 551, 561. Each of the rod-engaging holes 550, 560 has a generally horizontal hole portion 554, 564 and a generally vertical hole portion 555, 565 having an end connected to an end of the horizontal hole portion 554, 564. The retaining portion 552 of the first engaging plate 55 is aligned with the balance portion 563 of the second engaging plate 56, while the balance portion 553 of the first engaging plate 55 is aligned with the retaining portion 562 of the second engaging plate 56, as shown in FIGS. 6 and 8. Each of the first and second engaging plates 55, 56 is movable between a connection position shown in FIG. 6 and a retracted position shown in FIG. 8.

The electric driving mechanism 6 includes a motor 61, a keyboard member 62 operable to rotate an output shaft (not shown) of the motor 61 and, thus, an assembly of the rotary knob 52 and the lock-connecting rod 53, in two directions in a known manner. In another embodiment, the electric driving mechanism 6 may be omitted.

With particular reference to FIGS. 4, 6, 7A, and 7B, when the first and second engaging plates 55, 56 are disposed in the connection positions, the lock-connecting rod 531 is horizontal, and is located in the horizontal hole portions 554, 564 of the rod-engaging holes 550, 560 in the first and second engaging plates 55, 56. In this state, the retaining portions 552, 562 of the first and second engaging plates 55, 56 project from the slot 542 in the first seat 541 into the notches 417 in the outside handle 41, respectively, to thereby allow for co-rotation of the handle-connecting rod 43 with the outside handle 41. Hence, the outside handle 41 can be operated to open the door.

Figure 9A:
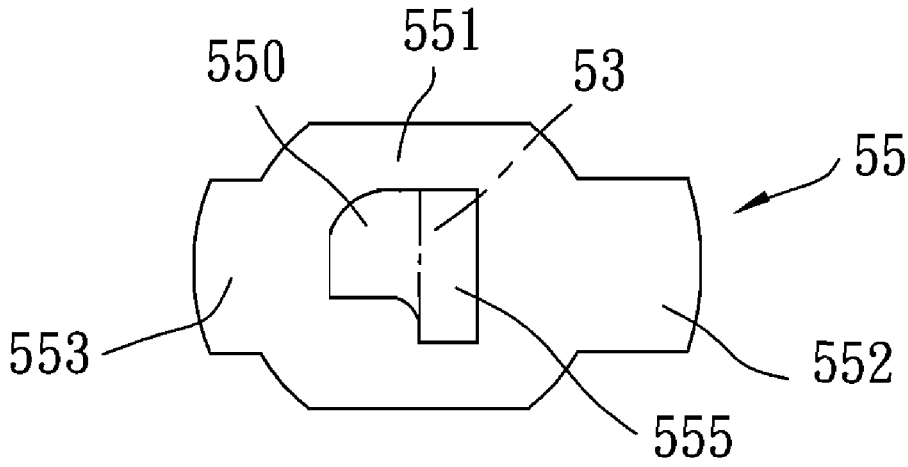
FIG. 9A is a fragmentary schematic view of the preferred embodiment, illustrating positioning of a lock-connecting rod relative to the first engaging plate when the first engaging plate is disposed in the retracted position.
Figure 9B:
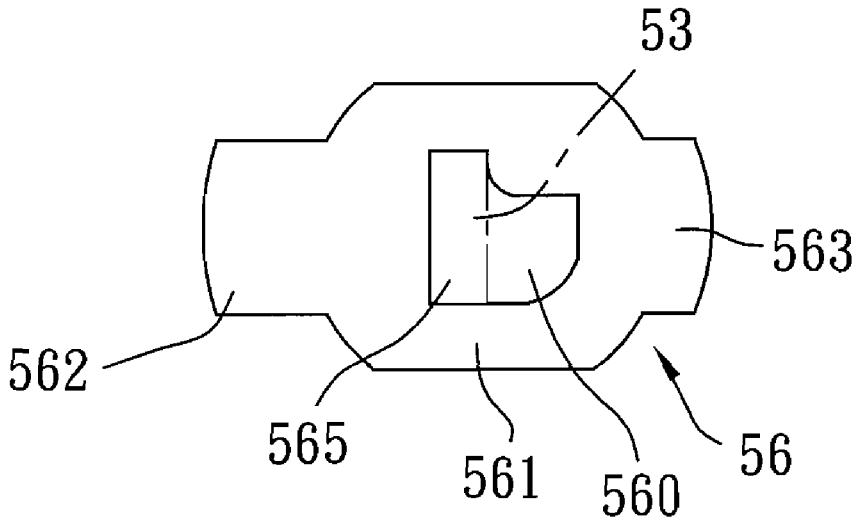
FIG. 9B is a fragmentary schematic view of the preferred embodiment, illustrating positioning of the lock-connecting rod relative to the second engaging plate when the second engaging plate is disposed in the retracted position.

To lock the door, any of the outside handle 41, the rotary knob 52, and the electric driving mechanism 6 can be operated to rotate the lock-connecting rod 53 to thereby move the first and second engaging plates 55, 56 from the connection positions to the retracted positions. With particular reference to FIGS. 8, 9A, and 9B, when the first and second engaging plates 55, 56 are disposed in retracted positions, the lock-connecting rod 53 is vertical, and is located in the vertical hole portions 555, 565 of the rod-engaging holes 550, 560 in the first and second engaging plates 55, 56. In this state, the retaining portions 552, 562 of the first and second engaging plates 55, 56 are retracted into the slot 542 in the first seat half 541 to thereby prevent co-rotation of the handle-connecting rod 43 (see FIG. 4) with the outside handle 41. As a consequence, when the outside handle 41 is rotated, the remaining members of the lock are kept intact. Thus, unlocking of the lock and subsequent opening of the door through operation of the outside handle 41 can be prevented to thereby promote the anti-theft effect of the lock.

With this invention thus explained, it is apparent that numerous modifications and variations can be made without departing from the scope and spirit of this invention. It is therefore intended that this invention be limited only as indicated by the appended claims.

I claim:

1. A two-handled lock comprising:

a locking housing unit;

a handle unit including an outside handle mounted rotatably on said lock housing unit, an inside handle mounted rotatably on said lock housing unit, and a handle-connecting rod connected to and co-rotatable with said inside handle, said outside handle defining a receiving chamber and having at least one notch; and a lock-controlling mechanism including:

a key-operated lockset mounted to said outside handle, a rotary knob mounted to said inside handle, a lock-connecting rod rotatable by said key-operated lockset and said rotary knob, a driven seat disposed rotatably within said receiving chamber in said outside handle and co-rotatable with said handle-connecting rod, said driven seat being formed with an open-ended slot, and a first engaging plate disposed movably within said slot in said driven seat and having a retaining portion, said first engaging plate being connected to said lock-connecting rod in such a manner to move in said slot in said driven seat as a result of rotation of said lock-connecting rod relative to said lock housing unit, said first engaging plate being movable between a connection position whereat said retaining portion of said first engaging plate projects from said slot in said driven seat into said notch in said outside handle so as to allow for co-rotation of said handle-connecting rod with said outside handle, and a retracted position whereat said retaining portion of said first engaging plate is retracted into said slot in said driven seat so as to prevent co-rotation of said handle-connecting rod with said outside handle.

2. The two-handled lock as claimed in claim 1, wherein said outside handle has two aligned said notches, said lock-controlling mechanism further including a second engaging plate disposed movably within said slot in said driven seat and having a retaining portion, said second engaging plate being connected to said lock-connecting rod in such a manner to move in said slot in said driven seat as a result of rotation of said lock-connecting rod relative to said lock housing unit, said retaining portion of said second engaging plate being movable to project from said slot in said driven seat into a corresponding one of said notches in said outside handle when said first engaging plate is disposed in said connection position, said retaining portion of said second engaging plate being movable to retract into said slot in said driven seat when said first engaging plate is disposed in said retracted position.

3. The two-handled lock as claimed in claim 2, wherein each of said first and second engaging plates further has a balance portion and a rod-engaging portion that is interconnected between said retaining portion and said balance portion and that is formed with a rod-engaging hole, which has a generally horizontal hole portion and a generally vertical hole portion having an end connected to an end of said horizontal hole portion, said lock-connecting rod being configured as a plate and extending through said rod-engaging holes in said first and second engaging plates, wherein, when said first engaging plate is disposed in said connection position, said lock-connecting rod is horizontal, and is located in said horizontal hole portions of said rod-engaging holes in said first and second engaging plates, and when said first engaging plate is disposed in said retracted position, said lock-connecting rod is vertical, and is located in said vertical hole portions of said rod-engaging holes in said first and second engaging plates.

4. The two-handled lock as claimed in claim 2, wherein said driven seat includes a first seat half sleeved on and co-rotatable with said handle-connecting rod, and a second seat half connected fixedly to said first seat half to define said slot therebetween.

5. The two-handled lock as claimed in claim 4, wherein said first seat half of said driven seat has a plate portion, two slot walls extending from a side of said plate portion toward said second seat half to define said slot between said slot walls, and a surrounding wall portion extending from an opposite side of said plate portion in a direction away from said slot walls, said plate portion and said surrounding wall portion cooperating to define an insert hole engaging said handle-connecting rod in such a manner to allow for co-rotation of said first seat half and said handle-connecting rod.

6. The two-handled lock as claimed in claim 5, wherein said surrounding wall portion of said first seat half of said driven seat is formed with a plurality of positioning grooves, and said handle-connecting rod is formed with a plurality of projections engaging respectively said positioning grooves in said surrounding wall portion.

* * * * *